US006285135B2

(12) United States Patent
Zimlich et al.

(10) Patent No.: US 6,285,135 B2
(45) Date of Patent: Sep. 4, 2001

(54) FIELD EMISSION DISPLAY HAVING CIRCUIT FOR PREVENTING EMISSION TO GRID

(75) Inventors: David A. Zimlich; David A. Cathey, Jr., both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/753,396

(22) Filed: Jan. 2, 2001

Related U.S. Application Data

(63) Continuation of application No. 09/496,561, filed on Feb. 2, 2000, now Pat. No. 6,169,371, which is a continuation-in-part of application No. 09/261,589, filed on Mar. 3, 1999, which is a continuation of application No. 08/623,509, filed on Mar. 28, 1996, now Pat. No. 5,910,791, which is a continuation-in-part of application No. 08/509,501, filed on Jul. 28, 1995, now Pat. No. 5,721,560.

(51) Int. Cl.[7] ..... G09G 3/10

(52) U.S. Cl. ..... 315/169.1; 315/169.3; 315/337; 345/212; 345/74.1; 345/76

(58) Field of Search ..... 315/167, 168, 315/169.1, 169.3, 337; 345/74.1, 76, 84, 211, 212, 214; 313/309, 351

(56) References Cited

U.S. PATENT DOCUMENTS

| | | | |
|---|---|---|---|
| 5,186,670 | | 2/1993 | Doan et al. . |
| 5,259,799 | | 11/1993 | Doan et al. . |
| 5,525,868 | | 6/1996 | Browning . |
| 5,581,159 | | 12/1996 | Lee et al. . |
| 5,638,085 | | 6/1997 | Hush et al. . |
| 5,638,086 | | 6/1997 | Lee et al. . |
| 5,656,892 | | 8/1997 | Zimlich et al. . |
| 5,708,451 | * | 1/1998 | Baldi ..... 345/75 |
| 5,721,560 | | 2/1998 | Cathey, Jr. et al. . |
| 5,910,791 | | 6/1999 | Zimlich et al. . |
| 6,169,371 | * | 1/2001 | Zimlich et al. ..... 315/169.1 |

OTHER PUBLICATIONS

Cathey, David A., "Field Emission Displays", published in VLSI, Taiwan, May–Jun. 1995.

* cited by examiner

*Primary Examiner*—Haissa Philogene
(74) *Attorney, Agent, or Firm*—Stephen A. Gratton

(57) ABSTRACT

A field emission display includes an array of emitter sites, a grid for controlling electron emission from the emitter sites, and a display screen. The field emission display also includes a control circuit for controlling the grid for preventing emission to grid. The control circuit includes a high impedance grid bias path, and a low impedance grid bias path. In addition, the control circuit includes a sensing-switching circuit for sensing an anode voltage at the display screen, and switching from the high impedance to the low impedance grid bias path upon detection of a threshold anode voltage. An alternate embodiment control circuit is configured to provide a programmable delay during enabling of the grid to insure that the display screen reaches the threshold voltage prior to electron emission. An alternate embodiment field emission display includes a focus ring that is controlled to prevent emission to grid.

15 Claims, 5 Drawing Sheets

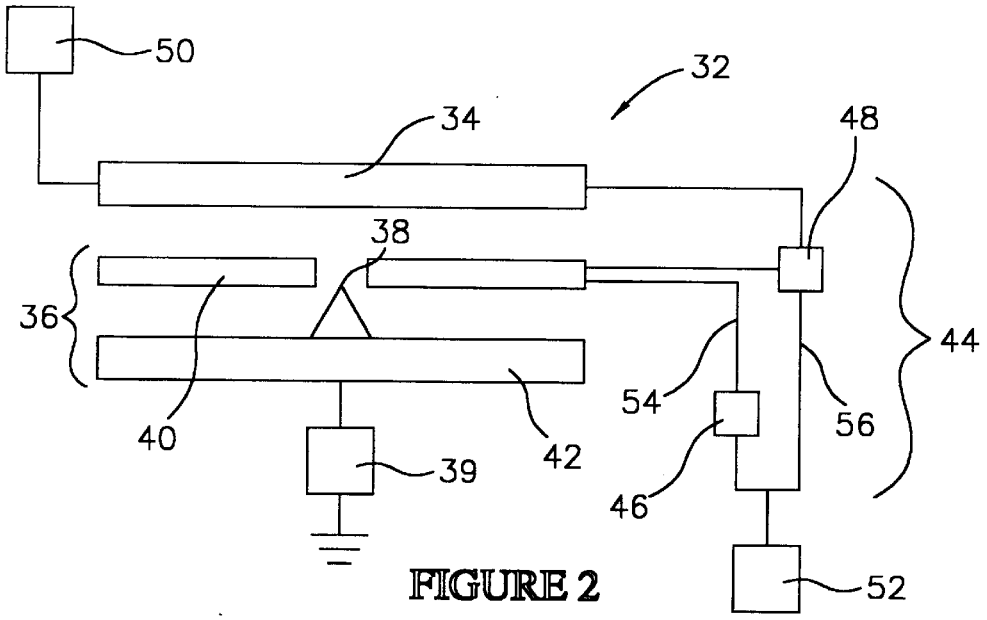
FIGURE 2
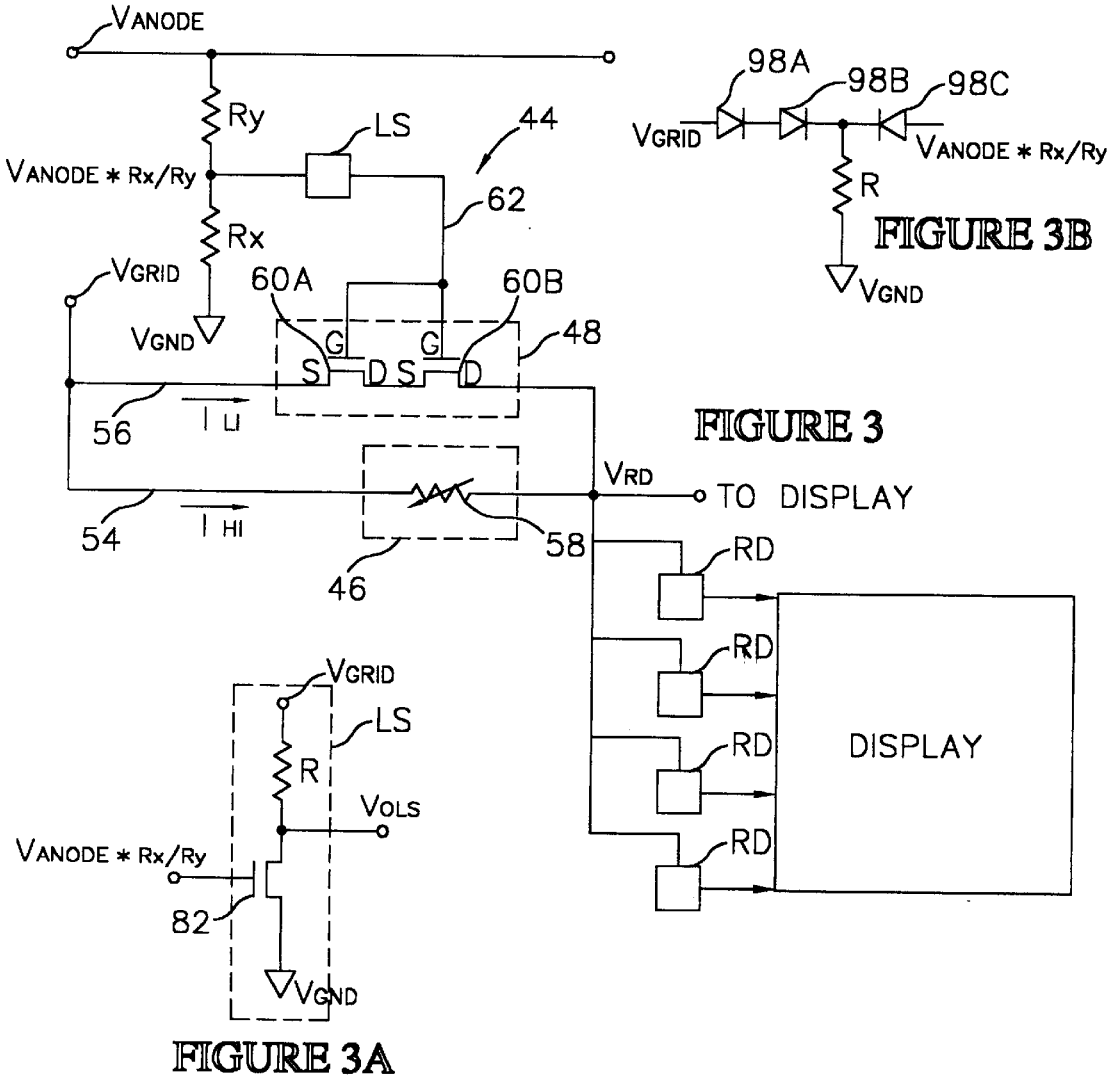
FIGURE 3B
FIGURE 3
FIGURE 3A

FIELD EMISSION DISPLAY HAVING CIRCUIT FOR PREVENTING EMISSION TO GRID

CROSS REFERENCE TO RELATED APPLICATIONS

This application is a continuation of application Ser. No. 09/496,561, filed Feb. 02, 2000, U.S. Pat. No. 6,169,371, which is a continuation-in-part of application Ser. No. 09/261,589, filed Mar. 03, 1999, which is a continuation of application Ser. No. 08/623,509, filed Mar. 28, 1996, U.S. Pat. No. 5,910,791, which is a continuation-in-part of application Ser. No. 08/509,501, filed Jul. 28, 1995, U.S. Pat. No. 5,721,560.

This invention was made with Government support under Contract No. DABT63-93-C-0025 awarded by Advanced Research Project Agency ("ARPA"). The government has certain rights in this invention.

FIELD OF THE INVENTION

The present invention relates generally to field emission displays (FEDs), and particularly to control circuits and methods for preventing emission to grid in field emission displays.

BACKGROUND OF THE INVENTION

One type of flat panel display is known as a cold cathode field emission display (FED). A cold cathode field emission display uses electron emissions to illuminate a cathodoluminescent screen and generate a visual image. A single pixel 10 of a prior art field emission display is shown in FIG. 1A. The pixel 10 includes a substrate 11 having a conductive layer 12, and an array of emitter sites 13 on the conductive layer 12. Although each pixel 10 typically contains many emitter sites (e.g., 4–20 for a small display and several hundred for a large display), for simplicity only one emitter site 13 is shown in FIG. 1A. An extraction grid 15 is associated with the emitter sites 13 and functions as a gate electrode. The grid 15 is electrically isolated from the conductive layer 12 by an insulating layer 18. The grid 15-conductive layer 12-substrate 11 subassembly is sometimes referred to as a baseplate.

Cavities 23 are formed in the insulating layer 18 and grid 15 for the emitter sites 13. The grid 15 and emitter sites 13 are in electrical communication with a power source 20. The power source 20 is adapted to bias the grid 15 to a positive potential with respect to the emitter sites 13. When a sufficient voltage differential is established between the emitter sites 13 and the grid 15, a Fowler-Nordheim electron emission is initiated from the emitter sites 13. The voltage differential for initiating electron emission is typically on the order of 20 volts or more.

Electrons 17 emitted at the emitter sites 13 collect on a cathodoluminescent display screen 16. The display screen 16 is separated from the grid 15 by an arrangement of electrically insulating spacers 22. The display screen 16 includes an external glass face 14, a transparent electrode 19 and a phosphor coating 21. Electrons impinging on the phosphor coating 21 cause the release of photons 25 which forms the image. The display screen 16 is the anode in this system, and the emitter sites 13 are the cathode. The display screen 16 is biased by the power source 20 (or by a separate anode power source) to a positive potential with respect to the grid 15 and emitter sites 13. The potential at the display screen 16 is termed herein as an anodic potential. In some systems the potential at the display screen 16 is on the order of 1000 volts or more.

One problem that occurs during operation of a field emission display is known as "emission to grid". Emission to grid refers to an undesirable flow of electrons from the emitter sites 13 to the grid 15, or to other elements of the field emission display, such as the spacers 22. Emission to grid is particularly a problem during turn on (power on), and turn off (power off), of the field emission display.

Emission to grid during turn on is illustrated in FIG. 1B. During the turn on process, electrons 26 emitted from the emitter sites 13 can go directly to the grid 15 rather than to the display screen 16. This situation can lead to overheating of the grid 15. Emission to grid can also affect the voltage differential between the emitter sites 13 and the grid 15. In addition, desorped molecules and ions can be ejected from the grid 15 causing excessive wear of the emitter sites 13. Electron emission to grid 15 can also lead to electrical arcing 30 between the grid 15 and the conductive layer 12, or between the grid 15 and the emitter sites 13. In addition, electrons 26 emitted from the emitter sites 13 can strike the spacers 22 causing a charge build up on the spacers 22.

All of these problems decrease the lifetime, performance and reliability of a field emission display. Electron emission to grid is particularly a problem in consumer electronic products, such as camcorders, televisions and automotive displays, which are typically turned on and off many times throughout the useful lifetime of the product.

One reason for electron emission to grid, is that electron emission may have commenced from the emitter sites 13 before the large anodic voltage potential ($V_{Anode}$) has been established at the display screen 16. Typically, the display screen 16 is a relatively large, relatively high voltage structure, that requires some period of time to reach full potential across its entire surface. In addition, the display screen 16 operates at a significantly higher voltage than any other component of the field emission display. Some period of time is required to ramp up to this operating voltage. Consequently, the display screen 16 can be at a low enough positive potential to allow electron emission to grid 15 to occur, as illustrated in FIG. 1B. Although this situation may only occur for a relatively short period of time, it can cause system problems as outlined above.

A related situation can also occur during turn on of the display screen 16 and grid 15 if the emitter sites 13 are not electrically controlled. If the emitter sites 13 are not limited during turn on, an uncontrolled amount of emission can occur causing the same problems as outlined above.

In addition, a similar situation exists during the turn off process for the FED cell 10 (i.e., power off). If power to the large positive potential at the display screen 16 is lost prior to termination of electron emission from the emitter sites 13, then electron emission to grid, as illustrated in FIG. 1B, can occur.

The present invention is directed to an improved field emission display and control circuit constructed to prevent electron emission to grid.

SUMMARY OF THE INVENTION

In accordance with the present invention, an improved field emission display configured to prevent emission to grid, is provided. Also provided is an improved method for controlling field emission displays to prevent emission to grid.

The field emission display includes emitter sites for emitting electrons, a grid (cathode) for controlling electron emission from the emitter sites, and a display screen (anode) for receiving electrons from the emitter sites to form a visual image. The field emission display also includes a control circuit for preventing electron emission to grid during operation of the field emission display.

The control circuit includes two separate electrical paths for biasing the grid: a high impedance grid bias path and a low impedance grid bias path. The high impedance grid bias path has an impedance selected to not allow electron emission from the emitter sites, which prevents emission to grid. The low impedance grid bias path has an impedance selected to allow electron emission from the emitter sites to occur. The high impedance grid bias path includes an impedance control circuit for controlling an impedance in the path. The low impedance grid bias path includes a sensing-switching circuit for sensing an anode voltage at the display screen, and switching between the separate electrical paths upon detection of a threshold anode voltage ($V_t$).

During turn-on of the FED, the display screen and the high impedance grid bias path are enabled. An anode voltage at the display screen is then sensed, and the low impedance grid bias path is enabled only upon detection of the threshold anode voltage. The control circuit permits the display screen to be enabled either before, or after, enabling of the high impedance grid bias path. In either case, the high impedance grid bias path maintains a grid bias level that will prevent electron emission from the emitter sites, and thus emission to grid, until the threshold anode voltage has been established. In a normal situation the display screen reaches full potential prior to the grid, by a time differential measured in milli-seconds or less.

During turn-off of the FED, the low impedance grid bias path is enabled as the anode voltage drops below the threshold anode voltage. As with the turn-on sequence, electron emission from the emitter sites, and emission to grid, are prevented.

The method for controlling field emission displays to prevent emission to grid includes the steps of: providing a field emission display with separate high impedance and low impedance grid bias paths, enabling the grid using the high impedance grid bias path, sensing an anode voltage, and switching to the low impedance grid bias path upon detection of a threshold anode voltage.

In a second embodiment, the field emission display includes a control circuit configured to provide a programmable delay for delaying enabling of the grid until the threshold anode voltage ($V_t$) is reached.

In a third embodiment, the field emission display includes a focusing ring for focusing electron emission from the emitter sites onto the display screen. In this embodiment the control circuit is constructed to enable the focusing ring prior to enabling of the emitter sites. This attracts electrons away from the grid, and towards the display screen.

BRIEF DESCRIPTION OF THE DRAWINGS

FIG. 2 is a schematic diagram of a field emission display constructed in accordance with the invention;

FIG. 3 is an electrical schematic of a control circuit constructed in accordance with the invention for controlling emission to grid during turn on and turn off of a field emission display;

FIG. 3A is an electrical schematic of a level shifter element for the control circuit of FIG. 3;

FIG. 3B is an electrical schematic of an alternate embodiment level shifter element for the control circuit of FIG. 3;

DETAILED DESCRIPTION OF THE PREFERRED EMBODIMENT

Figure 1A:
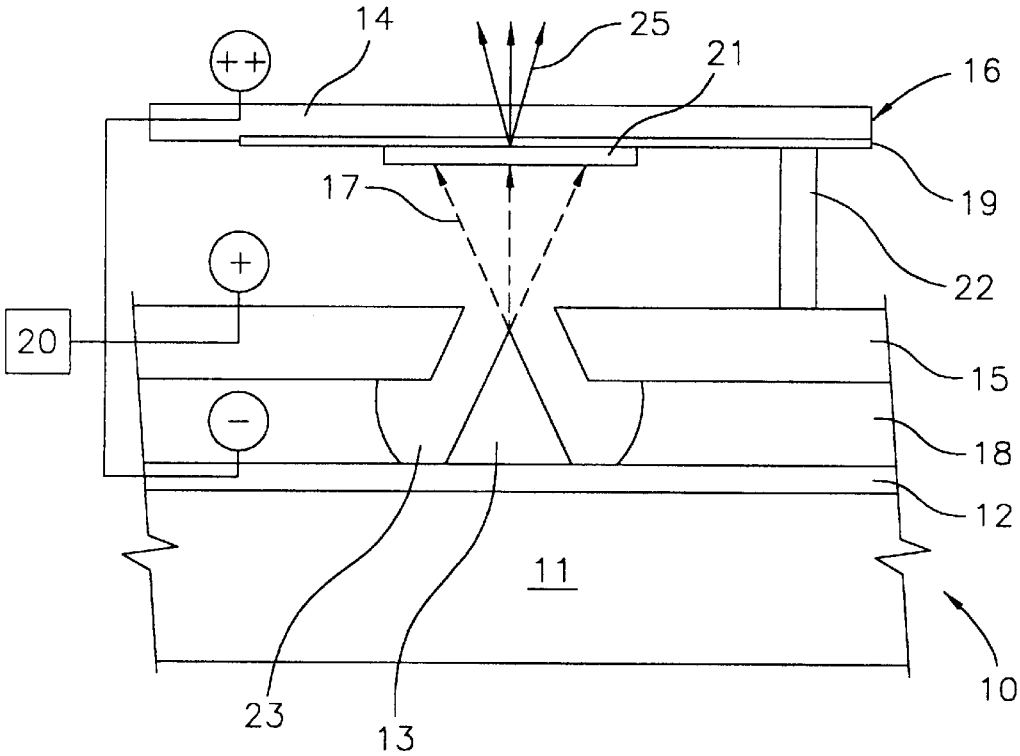
FIGURE 1A (PRIOR ART)
FIG. 1A is a schematic cross sectional view of a pixel of a prior art field emission display (FED)
Figure 1B:
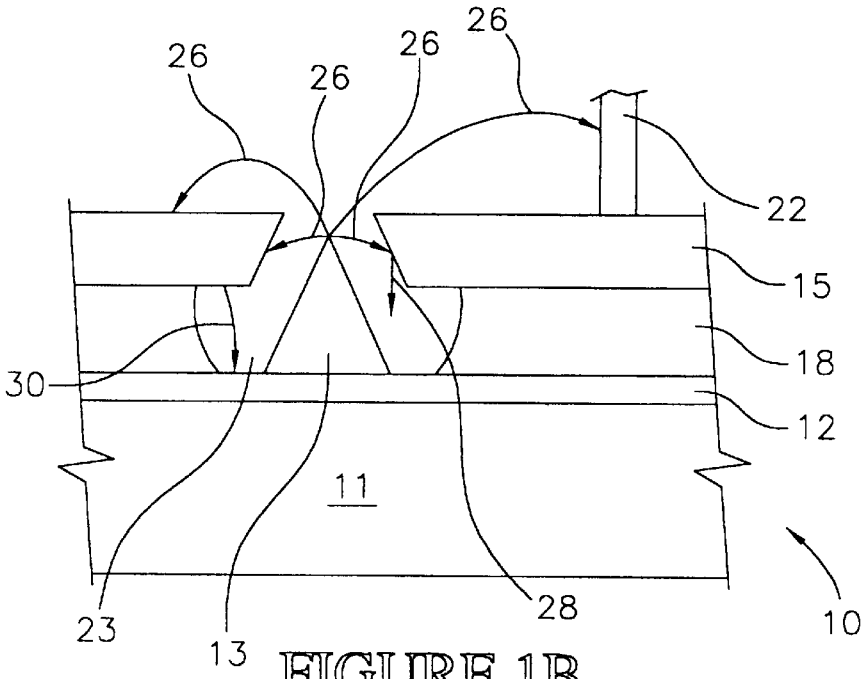
FIGURE 1B (PRIOR ART)
FIG. 1B is a schematic cross sectional view illustrating emission to grid occurring during turn on or turn off for the prior art field emission display shown in FIG. 1A.

Referring to FIG. 2, a field emission display 32 constructed in accordance with the invention is illustrated. The field emission display 32 includes a display screen 34 (anode), and a base plate 36.

The display screen 34 comprises a glass plate coated with a transparent conductive material, and a cathodoluminescent layer. A conventional anode voltage source 50 supplies a high positive voltage (e.g., 1–2 kV) to the display screen 34. During operation of the field emission display 32, electrons are attracted to the display screen 34, and strike the cathodoluminescent layer causing light to be emitted. The light forms a visual image which is viewable through the glass plate. The display screen 34 can be physically constructed using techniques that are known in the art.

The base plate 36 includes a plurality of emitter sites 38 formed on a substrate 42. The emitter sites 38 can be contained in pixels arranged in a display matrix of rows and columns, such that each pixel is uniquely identified by a row and column address. An emitter site 38 is enabled by simultaneously addressing the column and row for that emitter site (i.e., intersection of addressed column and row). The display matrix can be controlled using arrangements that are known in the art. For example, emitter sites in an active matrix arrangement are described in U.S. Pat. No, 5,357,172 to Lee et al., entitled "Current-Regulated Field Emission Cathodes For Use In A Flat Panel Display In Which Low-Voltage Row And Column Signals Control A Much Higher Pixel Activation Voltage", which is incorporated herein by reference.

The base plate 36 also includes a grid 40 for controlling electron emission from the emitter sites 38. The grid 40 is in electrical communication with a grid voltage source 52, which supplies a moderate positive voltage (e.g., 20–120V) for biasing the grid. At an enabled emitter site 38, the grid 40 establishes a grid to emitter site voltage differential. With the emitter sites 38 coupled to ground, a sufficient voltage differential between the grid 40 and the emitter sites 38 produces an electrical field, and initiates electron emission from an enabled emitter site 38.

The base plate 36 and the grid 40 can be physically constructed using methods and materials that are known in the art. For example, U.S. Pat. No. 5,186,670 to Doan et al. entitled "Method To Form Self Aligned Gate Structures And Focus Rings", which is incorporated herein by reference, describes a method for forming the baseplate 36 and the grid 40.

In addition to the display screen 34 and the baseplate 36, the field emission display 32 also includes a grid control circuit 44, for controlling the biasing of the grid 40. The grid control circuit 44 is constructed to prevent emission to grid in a manner to be hereinafter described.

The control circuit 44 includes two separate electrical paths for biasing the grid 40: a high impedance grid bias path 54, and a low impedance grid bias path 56. The high impedance grid bias path 54 has an impedance selected to prevent emission to grid, but which will not allow electron emission from the emitter sites 38 to occur. The high impedance grid bias path 54 includes an impedance control circuit 46 which is configured to adjust an impedance of the high impedance grid bias path 54. The low impedance grid bias path 56 has an impedance selected to allow electron emission from the emitter sites 38 to occur.

The control circuit 44 also includes a sensing-switching circuit 48. The sensing-switching circuit 48 is configured to sense an anode voltage ($V_{Anode}$) at the display screen 34, and to switch between the separate grid bias paths 54 or 56 upon detection of a threshold anode voltage ($V_t$). A representative range for the anode voltage $V_{Anode}$ can be from 1 kV to 2 kV. The threshold anode voltage ($V_t$) can be a selected percentage of $V_{Anode}$ (e.g., 10% to 90%).

Referring to FIG. 3, an illustrative electrical schematic for the control circuit 44 is illustrated. The control circuit 44 includes the high impedance grid bias path 54 configured to apply a high impedance current $I_{HI}$ to the grid row drivers RD for the DISPLAY. The high impedance current $I_{HI}$ is a minimal current selected to prevent normal operation of the emitter sites 38 (FIG. 2) and emission to grid. The control circuit 44 also includes the low impedance grid bias path 56 for applying a low impedance current $I_{LI}$ to the grid row drivers RD for the DISPLAY. The low impedance current $I_{LI}$ is a standard operating current selected to allow normal operation of the emitter sites 38 (FIG. 2).

The high impedance grid bias path 54 includes the impedance control circuit 46. In the embodiment illustrated in FIG. 3, the impedance control circuit 46 comprises a variable resistance device 58. The variable resistance device 58 comprises an external control configured to limit the current grid row drivers RD for the DISPLAY. In addition, a resistance value for the variable resistance device 58 can be selected as required to achieve a desired impedance (Z) for the high impedance grid bias path 54.

The low impedance grid bias path 56 includes the sensing-switching circuit 48, which is configured to enable the low impedance grid bias path 56 upon detection of the threshold voltage $V_t$. In the embodiment illustrated in FIG. 3, the sensing-switching circuit 48 includes an analog switch in the form of back to back switching devices 60A, 60B, such as a FET transistors. The sensing-switching circuit 48 also includes a level shifter LS.

The switching devices 60A, 60B include gate elements G in electrical communication with a sensing path 62 electrically connected through the level shifter LS to $V_{Anode}$. The gate elements G are configured to turn the switching devices 60A, 60B on, when $V_{Anode}$ is greater than the threshold voltage $V_t$. This enables the low impedance grid bias path 56 by completing the electrical path between $V_{Grid}$ and the grid row drivers RD for the DISPLAY.

In FIG. 3A, an exemplary level shifter LS is illustrated. The level shifter LS provides an output signal $V_{OLS}$ that is electrically communicated to the gate elements of the active switching devices 60A, 60B. The level shifter LS comprises an n-channel transistor 82 with its gate element controlled by $V_{Anode}$ * (Rx/Ry). The drain of transistor 82 is electrically connected to a resistor R and to $V_{Grid}$. The source of transistor 82 is electrically connected to ground. If the transistor 82 is sufficiently strong (relative to R) it will take the drain to ground. This causes $V_{OLS}$ to be equal to $V_{GND}$.

In FIG. 3B, another exemplary level shifter LS' is illustrated. The level shifter LS' includes a pair of diodes 98A, 98B in electrical communication with $V_{Grid}$ and with a resistor R to ground. The level shifter LS' also includes a diode 98C in electrical communication with $V_{Anode}$ * (Rx/Ry) and with resistor R to ground. If $V_{Anode}$ * (Rx/Ry) is less than $V_{Grid}$ then the gates G of the active switching devices 60A, 60B will be down by two diodes 98A, 98B (a greater number of diodes could also be employed) which will switch off the active switching devices 60A, 60B. If $V_{Anode}$ * (Rx/Ry) is greater than $V_{Grid}$ then it will take the gates G positive (i.e., higher than $V_{Grid}$) and enable the active switching devices 60A, 60B.

Figure 4:
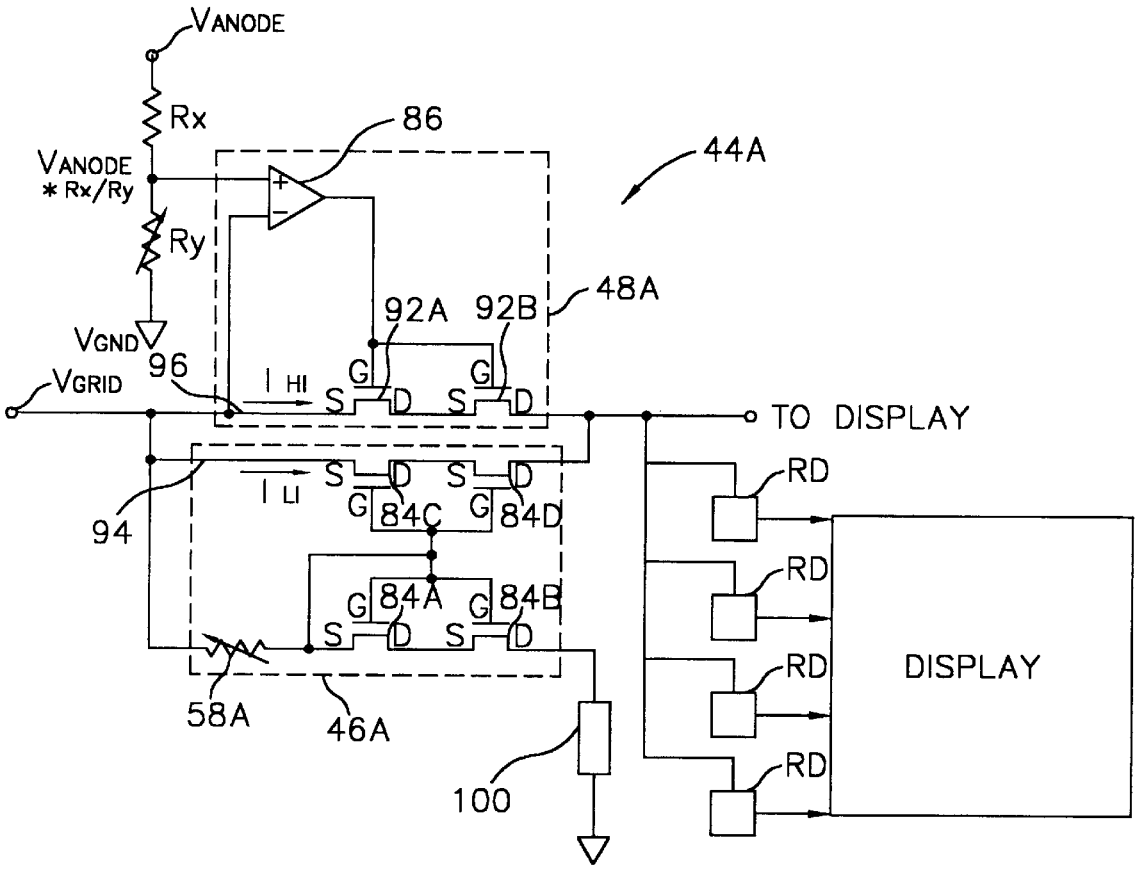
FIG. 4 in an electrical schematic of an alternate embodiment high impedance grid bias path with active switching devices.

Referring to FIG. 4, an alternate embodiment control circuit 44A is illustrated. The control circuit 44A includes an impedance control circuit 46A with a high impedance grid bias path 94. The control circuit 44A also includes a sensing-switching circuit 48A with a low impedance grid bias path 96.

The impedance control circuit 46A includes a variable resistance device 58A, which functions substantially as previously described. In addition, the impedance control circuit 46A includes active switching devices 84A, 84B, 84C, 84D, such as FETs. The gate elements of the switching devices 84A, 84B, 84C, 84D are electrically connected to one another and to the output of the variable resistance device 58A. The configuration of the active switching devices 84A, 84B, 84C, 84D is also known as a current mirror or a control knob resistor. An open drain device 100, such as a resistor, can be included in the circuit 46A, substantially as shown, to insure that the drain D of switching device 84B is equal to the drain D of switching device 84D. This arrangement allows the user or manufacturer of the field emission display 32 to adjust (e.g., tweak) the current of each display if necessary.

The sensing-switching circuit 48A includes back to back active switching devices 92A, 92B configured as an analog switch. The sensing-switching circuit 48A also includes a logical inverter 86. The inverter 86 is a simple logical inverter (i.e., not gate) or comparator with one input and one output. A first terminal (+) of the inverter 86 is electrically connected to $V_{Anode}$ * (Rx/Ry). A second terminal (−) of the inverter 86 is electrically connected to $V_{Grid}$. An output of the inverter 86 is electrically connected to the gate elements of the switching devices 92A, 92B. The inverter 86 detects when $V_{Anode}$ * (Rx/Ry) is greater than $V_{Grid}$ which enables the switching devices 92A, 92B by switching to a higher voltage (e.g., from approximately $V_{GND}$ to $V_{Grid}$).

During operation of the control circuit 44A, as $V_{Grid}$ increases, and provided $V_{Anode}<V_{Grid}$ then a minimal high impedance current $I_{HI}$ is supplied through high impedance grid bias path 94 to the grid row drivers RD for the DISPLAY. This permits the grid 40 (FIG. 2) to be enabled indefinitely prior to enabling of the display screen 32. Once the display screen 32 is enabled $V_{Anode}$ is detected and enables the low impedance grid bias path 96 for supplying low impedance current $I_{LI}$ to the row drivers RD for the DISPLAY. Accordingly, electron emission cannot occur from the emitter sites 38 (FIG. 2), until $V_{Anode}$ is above the threshold voltage $V_t$. However, the grid 40 (FIG. 2) can be enabled anytime without electron emission to grid occurring.

Figure 5:
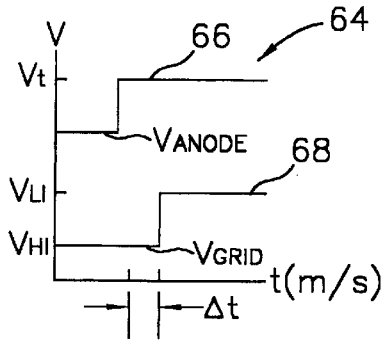
FIG. 5 is a graph illustrating operational characteristics of a field emission display constructed in accordance with the invention.

Referring to FIG. 5, operational characteristics of the field emission display 32 (FIG. 2) are illustrated in a graph 64. The graph 64 includes a y axis designated as voltage (V), and an x axis designated as time (t) in milli-seconds. In addition, the graph 64 includes a $V_{Anode}$ curve 66 and a $V_{Grid}$ curve 68. Upon enabling of the display screen 34, $V_{Anode}$ rises to the threshold voltage $V_t$. Upon enabling of the high impedance grid bias path 54 (FIG. 3) or 94 (FIG. 4), the grid is biased to $V_{Grid}$. However, $V_{Grid}$ is at a high impedance voltage $V_{HI}$ that will prevent electron emission from the emitter sites 38, and emission to grid. Once the threshold voltage $V_t$ is reached by the display screen 34, the low impedance grid bias path 56 (FIG. 3) or 96 (FIG. 4) is enabled, and the grid 40 is biased to a low impedance voltage $V_{LI}$. The low impedance voltage $V_{LI}$ is sufficient to maintain electron emission from the emitter sites 38. In addition, there is a time differential t between $V_{Anode}$ reaching $V_t$, and $V_{Grid}$ reaching $V_{LI}$.

Figure 6:
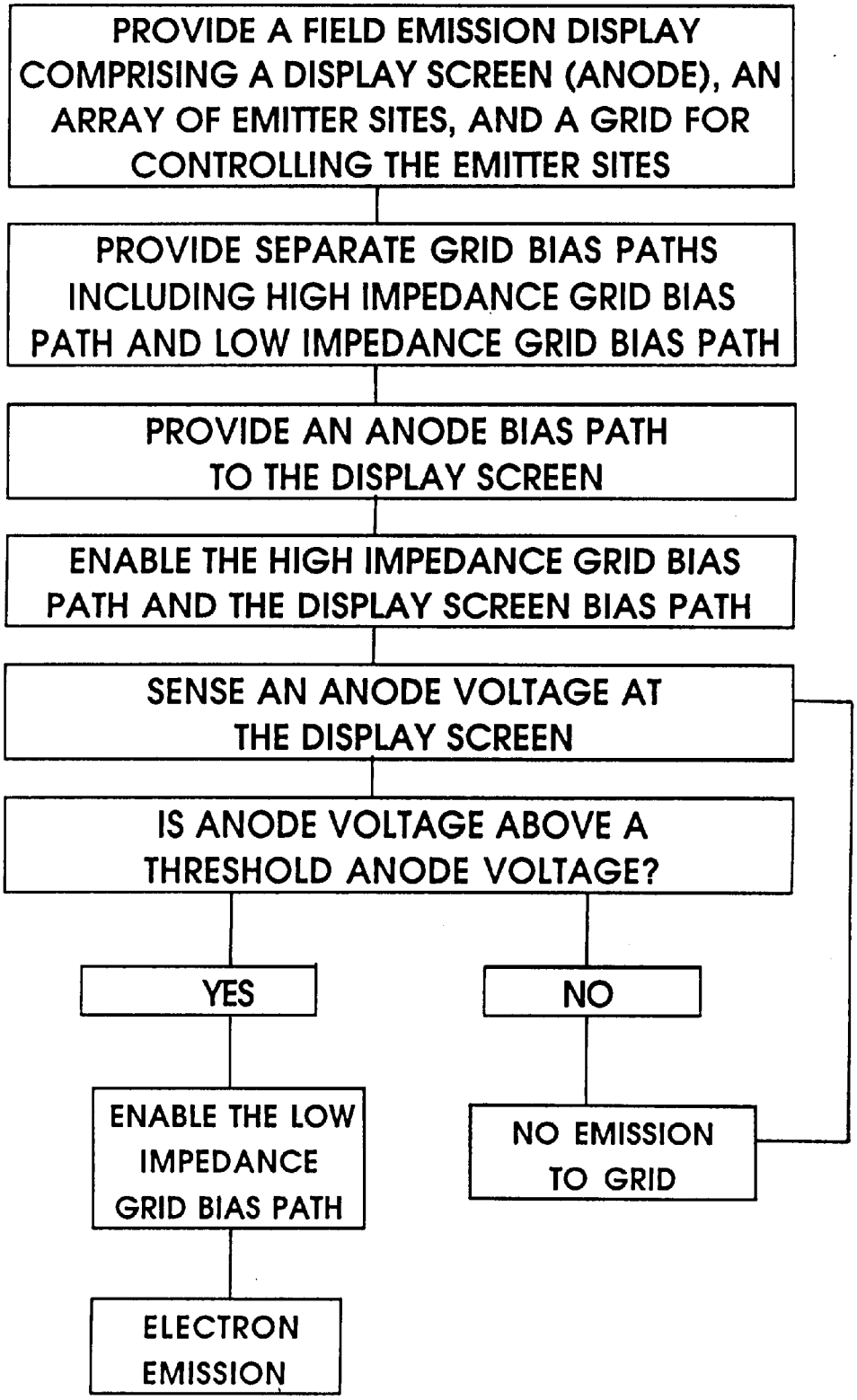
FIG. 6 is a flow diagram illustrating steps in a method for preventing emission to grid in the field emission display constructed in accordance with the invention.

Referring to FIG. 6, broad steps in a method for controlling a field emission display to prevent emission to grid are illustrated. As a first step, a field emission display comprising a display screen (anode), an array of emitter sites, and a grid (cathode) for controlling the emitter sites, is provided.

The field emission display is also provided with separate grid bias paths, including a high impedance grid bias path, and a low impedance grid bias path. The high impedance grid bias path has an impedance selected to prevent electron emission from the emitter sites, and emission to grid. The low impedance grid bias path has an impedance selected to allow normal operation of the emitter sites. The separate grid bias paths are in electrical communication with a suitable grid voltage source.

In addition to the grid bias paths, an anode bias path to the display screen is provided. The anode bias path is in electrical communication with a suitable anode voltage source.

For operating the field emission display, the high impedance grid bias path, and the anode bias path are enabled. Enabling of these bias paths can be in any sequence.

With the high impedance grid bias path and the anode bias path enabled, an anode voltage $V_{Anode}$ at the display screen is sensed. Sensing of the anode voltage $V_{Anode}$ can be accomplished using a suitable sensing circuit.

If the anode voltage $V_{Anode}$ is above the threshold voltage $V_t$, then the low impedance grid bias path can be enabled, causing electron emission from the emitter sites to occur.

If the anode voltage $V_{Anode}$ is below the threshold voltage $V_t$, then emission to grid is prevented, as the sensing step is continued.

Figure 7:
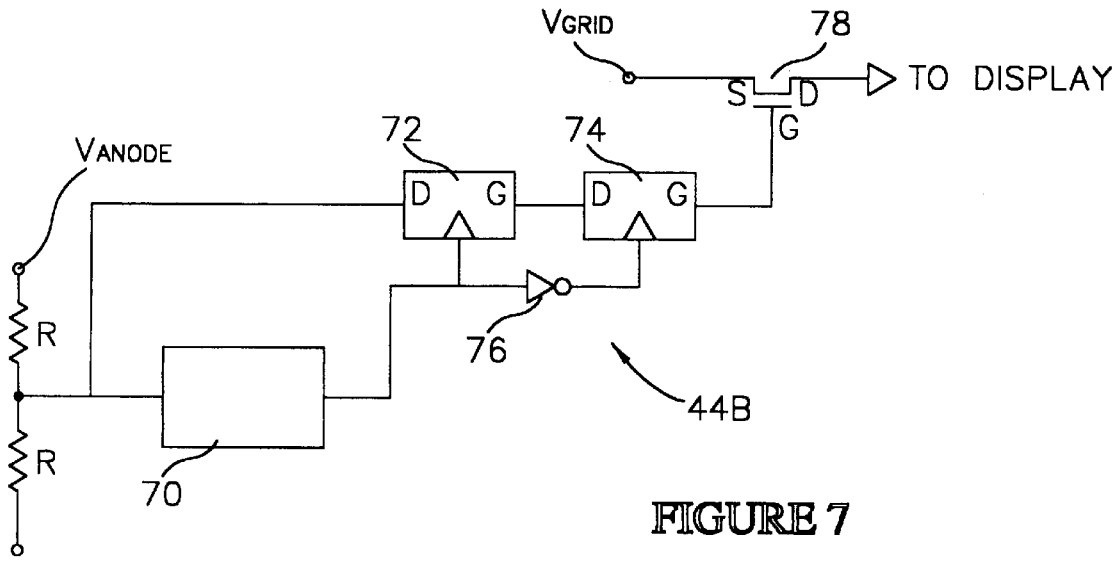
FIG. 7 is an electrical schematic of an alternate embodiment programmable delay control circuit configured to prevent emission to grid in a field emission display.

Referring to FIG. 7, an alternate embodiment grid control circuit 44B is illustrated. The grid control circuit 44B is configured to provide a programmable delay in which enabling of the grid 40 (FIG. 2) is delayed until the threshold voltage Vt is reached at the display screen 34 (FIG. 2). The grid control circuit 44B includes an enable OSC 70, which comprises a voltage controlled oscillator. In addition, the grid control circuit 44B includes a first d-type flip flop element 72, and a second d-type flip flop element 74 electrically connected in series. The grid control circuit 44B also includes a gate element 76 electrically connected to the flip flop elements 72, 74 and to the enable OSC 70 substantially as shown. The grid control circuit 44A also includes a pass transistor 78, such as an FET, in the $V_{Grid}$ electrical path. With the grid control circuit 44A, if power to the grid 40 (FIG. 2) is enabled then the pass transistor 78 is in an "off" state. Application of power to the display screen 34 (FIG. 2), enables the enable OSC 70. When the threshold voltage Vt is reached the enable OSC 70 loads logic ones on the gate element of the pass transistor 78. The pass transistor 78 then switches "on" such that the grid row drivers for the DISPLAY are enabled.

Figure 8:
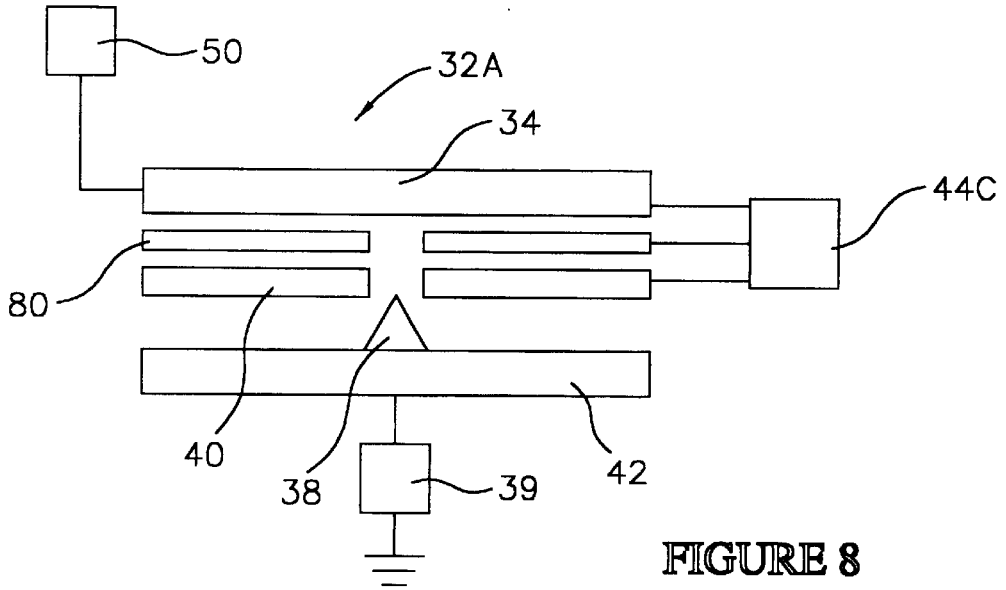
FIG. 8 is a schematic diagram of an alternate embodiment field emission display constructed in accordance with the invention.

Referring to FIG. 8, an alternate embodiment field emission display 32A constructed in accordance with the invention is illustrated. The field emission display 32A includes the display screen 34, the array of emitter sites 38, and the grid 40, which function substantially as previously described. In addition, the field emission display 32A includes a focus ring 80 mounted proximate to the emitter sites 38. The focus ring 80 functions to collimate the beams of electrons emitted from the emitter sites 38, and to focus the electrons on selected portions of the display screen 34 to improve the resolution of the projected image. The focus ring 80 can be physically constructed as disclosed in U.S. Pat. No. 5,259,799 to Doan et al. entitled, "Method to Form Self Aligned Gate Structures And Focus Rings", which is incorporated herein by reference.

Figure 9:
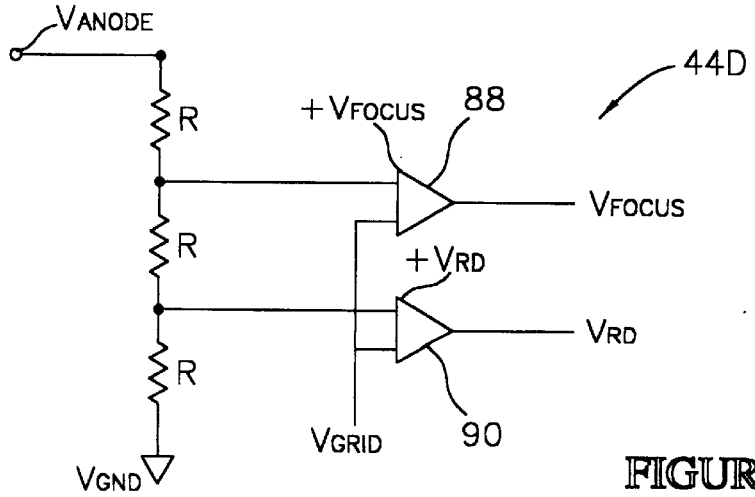
FIG. 9 is an electrical schematic of a control circuit for preventing emission to grid in the field emission display of FIG. 8.

The field emission display 32A also includes a control circuit 44C for controlling the focus ring 80 and the grid 40 to prevent emission to grid. The control circuit 44C is shown in FIG. 9. The control circuit 44C includes a $+V_{FOCUS}$ comparator 88 for controlling $V_{FOCUS}$ to the focus ring 80 and a $+V_{RD}$ comparator 90 for controlling $V_{RD}$ for the row drivers. A first terminal of the comparators 88, 90 is in electrical communication with $V_{Anode}$ divided by three resistors R, configured substantially as shown in electrical communication with ground. A second terminal of the comparators 88, 90 is in electrical communication with $V_{Grid}$. With this arrangement, the comparator 88 will enable the focus ring 80 only if a resistor divided $V_{Anode}$ exceeds a $V_{Grid}$ threshold. With the focus ring enabled electrons are attracted away from the grid 40, and towards the display screen 34.

Thus the invention provides an improved field emission display and circuit for preventing emission to grid. Although the invention has been described with reference to certain preferred embodiments, as will be apparent to those skilled in the art, certain changes and modifications can be made without departing from the scope of the invention as defined by the following claims.

We claim:

1. A field emission display comprising:

a plurality of emitter sites configured for electron emission;

a display screen configured to receive the electron emission to form a visual image;

a grid configured to control the electron emission; and a control circuit configured to detect a voltage at the display screen and to provide a programmable delay in which enabling of the grid is delayed until a threshold voltage is detected at the display screen.

2. The field emission display of claim 1 wherein the control circuit comprises a voltage controlled oscillator.

3. The field emission display of claim 1 wherein the control circuit comprises a voltage controlled oscillator and at least one flip flop element in electrical communication with the voltage controlled oscillator.

4. A field emission display comprising:

a plurality of emitter sites configured for electron emission;

a display screen configured to receive the electron emission to form a visual image;

a grid for controlling the electron emission;

a focus ring for focusing the electrons onto the display screen; and a control circuit configured to sense a voltage at the display screen and to enable the focus ring provided the voltage is above a threshold voltage.

5. The field emission display of claim 4 wherein the control circuit comprises a comparator configured to detect the voltage.

6. The field emission display of claim 4 wherein the control circuit comprises a comparator configured to detect the voltage and a grid voltage and to enable the emitter sites provided the voltage is above the threshold voltage.

7. A method for controlling a field emission display comprising:

providing a plurality of emitter sites, a grid for controlling electron emission from the emitter sites, and a display screen for receiving the electron emission to form a visual image;

providing a control circuit comprising a first grid bias path having a first impedance selected to prevent the electron emission, and a second grid bias path selected to allow the electron emission;

sensing a voltage at the display screen;

enabling the grid using the first grid bias path when the voltage is above a threshold voltage; and preventing the electron emission using the second grid bias path when the voltage is below the threshold voltage.

8. The method of claim 7 wherein the control circuit comprises at least one active electrical switching device.

9. The method of claim 7 wherein the control circuit comprises an analog switch configured to switch to the second grid bias path at the threshold voltage.

10. The method of claim 7 wherein the first grid bias path comprises at least one variable resistance device.

11. A method for controlling a field emission display comprising:

providing a plurality of emitter sites configured for electron emission;

providing a display screen configured to receive the electron emission to form a visual image;

providing a grid configured to control the electron emission;

detecting a voltage at the display screen; and delaying enabling of the grid until a threshold voltage is detected at the display screen.

12. The method of claim 11 wherein the delaying step is performed using a voltage controlled oscillator.

13. The method of claim 11 wherein the delaying step is performed using a voltage controlled oscillator and one active electrical switching device in electrical communication with the voltage controlled oscillator.

14. A method for controlling a field emission display comprising:

providing a plurality of emitter sites, a focus ring for focusing the electron emission, and a display screen for receiving the electron emission to form a visual image;

sensing a voltage at the display screen;

enabling the focus ring to provide the electron emission when the voltage is above a threshold voltage; and preventing the electron emission by not enabling the focus ring when the voltage is below the threshold voltage.

15. The method of claim 14 wherein the sensing step is performed using a comparator.

* * * * *